United States Patent [19]

Bull

[11] Patent Number: 4,513,872

[45] Date of Patent: Apr. 30, 1985

[54] CONTAINERS

[75] Inventor: Cyril A. Bull, Mansfield, England

[73] Assignee: Metal Box, PLC, Reading, England

[21] Appl. No.: 416,039

[22] Filed: Sep. 8, 1982

[30] Foreign Application Priority Data

Nov. 19, 1981 [GB] United Kingdom ..... 8134933

[51] Int. Cl.[3] ..... B65D 1/16

[52] U.S. Cl. ..... 220/74; 220/355

[58] Field of Search ..... 220/74, 355

[56] References Cited

U.S. PATENT DOCUMENTS 1,967,256 7/1934 Peters ..... 220/74
2,335,647 11/1943 Chamberlain ..... 220/74

FOREIGN PATENT DOCUMENTS 0005264 5/1978 European Pat. Off. .
2265 of 1886 United Kingdom ..... 220/74
393056 6/1933 United Kingdom .
1457769 12/1973 United Kingdom .
1577162 8/1976 United Kingdom .

*Primary Examiner*—Stephen Marcus
*Assistant Examiner*—David Voorhees
*Attorney, Agent, or Firm*—Diller, Ramik & Wight

[57] ABSTRACT

A metal container drawn from a sheet of tinplate has an end wall and a tapered tubular side wall extending from the end wall to culminate in a curl which defines the mouth. The curl (4) has a convex outer annulus to engage with the lining compound (11) in a lid (6) and a concave inner annulus which serves to stiffen the curl so that a peripheral folded portion (18), which joins the inner annulus to the outer annulus, bites into the skirt of a lid when crimped onto the curl to achieve a secure closure. A method and apparatus for making the container are described.

1 Claim, 9 Drawing Figures

CONTAINERS

This invention relates to a container body having a tubular side wall terminating in an external curl which defines a mouth which may be closed by a removable and replaceable lid, and more particularly but not exclusively to containers closed by a lid which has a skirt crimped into mechanical engagement with the curl to hold a gasket in the lid in sealing engagement with the mouth of the container. The invention further relates to a method and apparatus for making such containers.

One such container is described in British Patent Specification No. 1159199, in which the curl and side wall form an apex which engages with a sealing gasket in the lid. The curl further comprises a side portion which in cross section is in the form of an obtuse angled triangle. The lid skirt is crimped radially inwards under the lower side of the obtuse angle to pull the mouth of the container into sealing engagement with the gasket so that the container may be vacuum sealed without thermo softening of the gasket. However the convergent portions of crimped skirt of the lid and lower side of the curl may slip to a loose position if the container is subjected to abuse in a lateral direction.

Another such container is described in British Pat. No. 1457 769, in which the curl, when viewed in cross section, is greater in length along the container axis than it is wide in a direction radial to the container axis, and has the shape of a rounded triangle or trapezium having one side running perpendicularly or substantially pependicularly to the container axis, said one side being remote from the open end of the container. In effect this curl is of triangular cross section in which the apex bites into the sealing gasket in a lid and the base of the triangle prevents the curl collapsing when the curl is subjected to abuse in a lateral direction. Although these containers are used to convey vacuum packed printing ink, we believe that it is difficult to mass produce curls having the one side substantially at right angles to the container axis This invention provides a container comprising a tubular side wall terminating at one end in an outwardly directed curl defining the mouth of the body characterised in that the curl has a first annulus of arcuate cross section extending outwardly from the side wall to define a convex external surface for engagement with a gasket in a lid and a concave internal surface; a folded portion turning radially inwards from the outer periphery of the first annulus; and a second annulus extending radially inwards from the folded portion so that a convex surface of the second annulus extends adjacent to the concave inner surface of the first annulus.

In one embodiment of the container body a marginal edge portion of the second annulus extends between the convex surface of the second annulus and the concave surface of the first annulus.

The combined hoop strengths of the first and second annulii give rise to a curl which is resistant to lateral abuse in a manner consistent with the old technique in which a wire loop was enclosed in the curl. However, in contrast to the wired curls the folded portion, supported by the annulii, is able to exert a "biting" engagement with the skirt of a lid fitted over the curl, when the lid skirt is crimped radially inwards under the curl so that the closure is able to resist abuse.

The invention further provides a method of reforming an outwardly directed curl on a tubular sidewall of container body said method comprising the steps of engaging a first die with the curl so that a groove in the die prevents lateral spread of the curl, and applying a second die to that portion of the curl not supported by the first die so that relative motion as between the first and second dies imposes a crushing force to create a reformed curl having a first annulus of arcuate cross section extending outwardly from the side wall to define a convex external surface; a folded portion turning radially inwards from the outer periphery of the first annulus, and a second annulus extending radially inwards from the folded portion so that a convex surface of the second annulus extends adjacent to the concave inner surface of the first annulus.

In one embodiment of the method the first die creates the curl, while restraining the curl material against lateral spread.

The side wall of the container may, if desired, be clamped between internal centring means and exterior support means while the curl is crushed.

The second die may be a wedge shaped annulus and the apex of the wedge is applied to that portion of the outwardly directed curl supported by the first die on a circle of diameter greater than that of the circular centre line of a round curl so that a marginal edge portion of a second annulus is folded to lie between the convex surface of the second annulus and the concave surface of the first annulus.

The invention also provides apparatus for reforming an outwardly directed curl on a tubular side wall of a container, said apparatus having a first die having a groove to engage with the inside and outside of the curl to prevent lateral spreadIng of the curl, a second die having a convex surface enterable into the groove of the first die and means to cause relative motion as between the first and second dies to crush the curl.

In one embodiment of the apparatus the groove in the first die includes a profile to curl the free edge of a container body.

The first die may be mounted on tool having centring means to centre the container in relation to the first die and second die.

In one embodiment of the apparatus the centring means of the first die is a centring block enterable into the container and the centring means of the second die is a supporting cup which surrounds the container.

This invention therefore provides a container having a tubular side wall terminating at one end in an outwardly directed curl which is consistently controlled in shape and size by dies so that a good fit between the curl and a lid is possible.

Various embodiments will now be described by way of example and with reference to the accompanying drawings in which.

Figure 1:
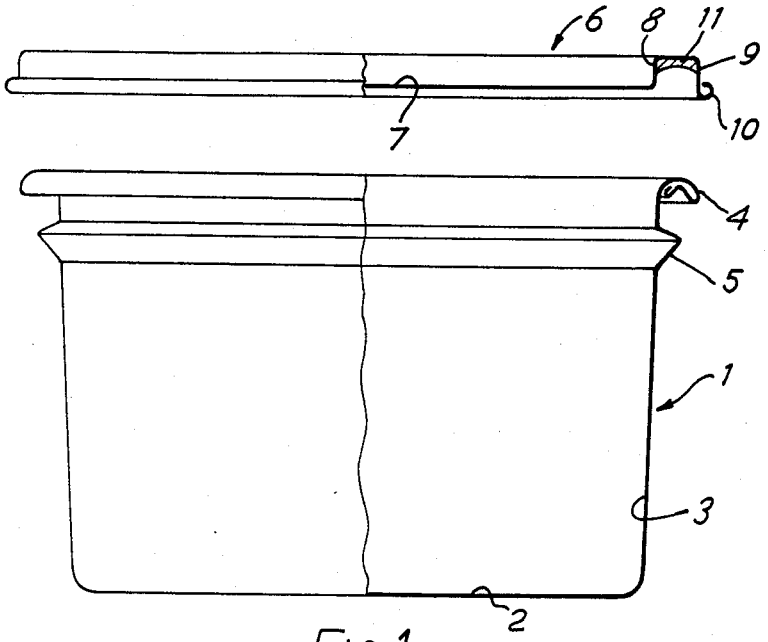
FIG. 1 is a side elevation of a container body and lid, each partly shown in section on a diameter.
Figure 2:
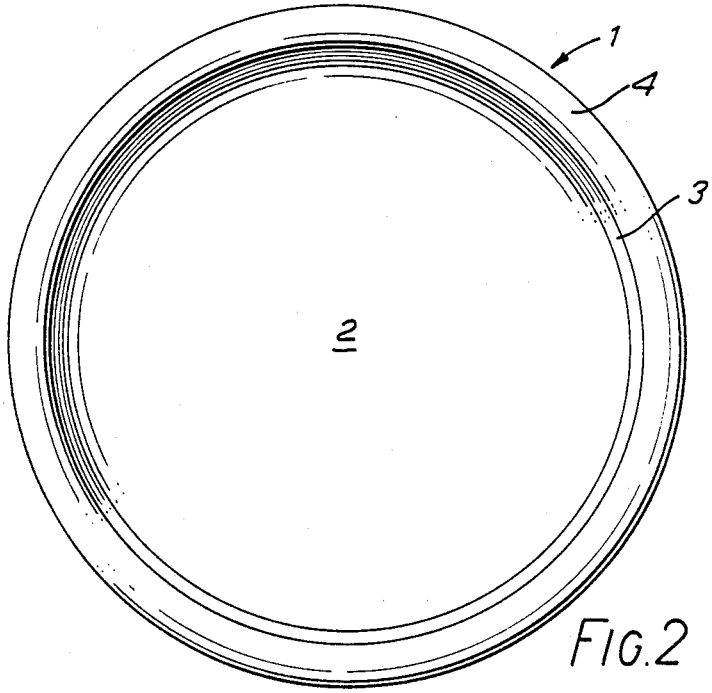
FIG. 2 is a plan view of the container body of FIG. 1.

FIG. 1 shows a container body 1 drawn from a blank of sheet metal to have an end wall 2 and a tapered tubular side wall 3 upstanding therefrom. The container is about 200 mm. diameter by about 127 mm. deep and the tinplate blank is 0.28 mm. thick so that the container is not inherently very rigid. Hoop strength is conferred on the container body by means of the curl 4 which defines the mouth of the container body and an annular bead 5 in the side wall so that the rim may receive a lid 6 shown above the body 1.

The side wall 3 is tapered to permit the nesting of one container within another to save space during storage and transport before the containers are filled. The annular bead 5 serves not only to hold the containers apart so that they can readily be denested but also as a fulcrum for use when the lid is to be prised off the container.

The lid 6 comprises a closure panel 7 surrounded by a channel 8 from which depends a peripheral skirt 9 which terminates in an outwardly directed curl 10. A gasket 11 of a lining compound is provided in the channel 8. In a preferred embodiment the lining compound is a puff compound which is particularly compressible.

Figure 3:
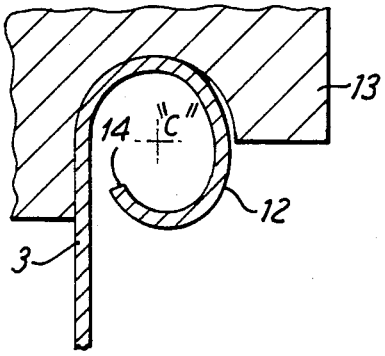
FIG. 3 is an enlarged cross sectional view of a conventional curl and curling die.

When initially drawn by the press tool, the side wall 3 had no flange at the mouth. The conventional curl 12 (FIG. 3) was made by bringing a die 13 to bear on the top free edge 14 of the side wall 3 to create a conventional die curl 12 as shown in FIG. 3 in which the conventional die curl can be seen to be round in cross section. The round shape is somewhat longer in length along the container axis than it is wide in the radial direction as comes naturally from die curling. It will be noticed that this conventional curl is tighter in curvature than the die profile so that only the inside diameter of the die curl 12 is reproducible and accurate. A notional centre line is marked "C" and will be referred to later. The action of the curling die 13 is stopped when the free edge 14 of the conventional die curl 12 nearly reaches the side wall 3 as shown in FIG. 3.

Figure 4:
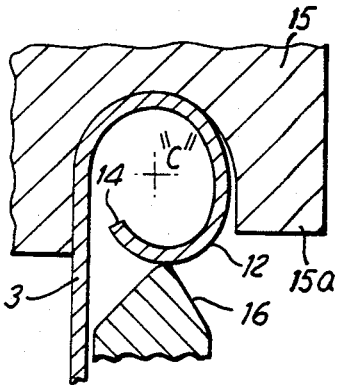
FIG. 4 is an enlarged cross sectional view of the conventional curl supported in a first die.

FIG. 4 shows the conventional die curl 12 just before a crushing action is imposed by an upper die 15 co-operating with a lower die 16. The upper die 15 has a longer outer portion 15*a* than the conventional curling die so that the maximum diameter of the curl 12 is controlled. The upper die 15 has a contour to support the convex upper surface of the conventional die curl 12 against the penetrating action of the lower die 16 which has a wedge shape the apex of which engages substantially the middle of the lower portion of the conventional die curl 12. Although a wedge shaped lower tool is described other profiles may be used if desired. For example, a semi-circular profile may be used.

Figure 5:
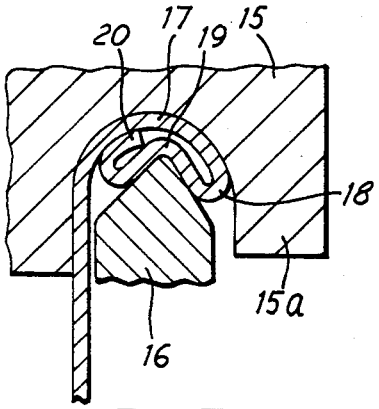
FIG. 5 is an enlarged cross sectional view of the curl after reforming by co-operation of the first die and a second die.

In FIG. 5 the lower tool 16 has been raised to crush the conventional die curl 12. During this crushing operation the outer portion 15*a* of die 15 prevents lateral spread of the curl so a reformed curl is created comprising a first annulus 17 of arcuate cross section extending outwardly from the side wall 3 to define a convex external surface for engagement with a gasket in a lid and a concave internal surface; a tightly folded portion 18 turning radially inwards from the outer periphery of the first annulus; and a second annulus 19 extending radially inwards from the folded portion 18 so that a convex surface of the second annulus extends adjacent to the concave inner surface of the first annulus 17. The crushed curl is therefore accurately defined in respect of its internal and external diameters.

In FIG. 5 a free marginal edge portion 20 of the second annulus 19 is shown lying between the convex surface of the second annulus 19 and the concave surface of the first annulus 17; however, if desired, this feature may be omitted by ensuring that the start curl 12 is too short to reach the side wall 3.

The marginal edge portion 20 may be encouraged to enter between the first and second annulii by applying the apex of lower tool 16 to the lower part of the conventional die curl at a location radially outward from the centre line of the conventional die curl so that as the tool 16 is raised the sloping face forces more curl material towards the side wall 3.

However, the marginal edge portion may be brought to the variable location during the formation of the conventional die curl by simply continuing the die curling operation a little longer so that the free edge 14 overlaps, and continues further around. This action gains more material within the conventional die curl.

Figure 6:
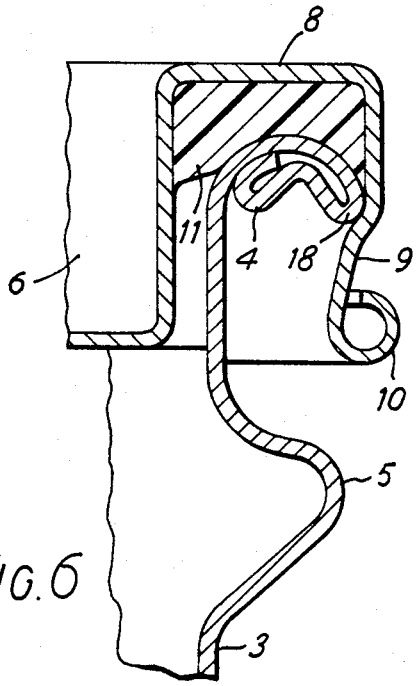
FIG. 6 is an enlarged cross sectional view of the curl of a container after the lid has been crimped into engagement with the curl.

FIG. 6 shows a lid 6 after the skirt 9 has been crimped radially inwards to enter the skirt 9 under the folded portion 18 of the curl 4. It is brought that the radial component of force arising from the crimping of the lid skirt passes through the tightly folded portion 18 to the second annulus to push the first annulus into the gasket 11 to make sealing engagement between the gasket and convex surface of the first annulus 17. The tightly folded portion 18 is able to bite into the crimped skirt 9 of the lid 6 to achieve good lid retention as may be necessary to contain a vacuum. Any forces arising from laterally directed abuse are therefore passed into the lining compound.

The container is opened by inserting a lever between the curl 10 of the lid 6 and the buttress shaped bead 5 and thereafter using the bead as a fulcrum to prise lid 6 and body 1 apart.

Whereas the method described with reference to FIGS. 3,4 and 5 makes use of a conventional start curling die 13 and further reforming dies 15,16 a modified upper die 15 may alternatively be used to make a preliminary curl which it then supports while the lower die 16 co-operates to crush the preliminary curl as will be described with reference to the apparatus shown in FIGS. 7,8 and 9.

Figure 7:
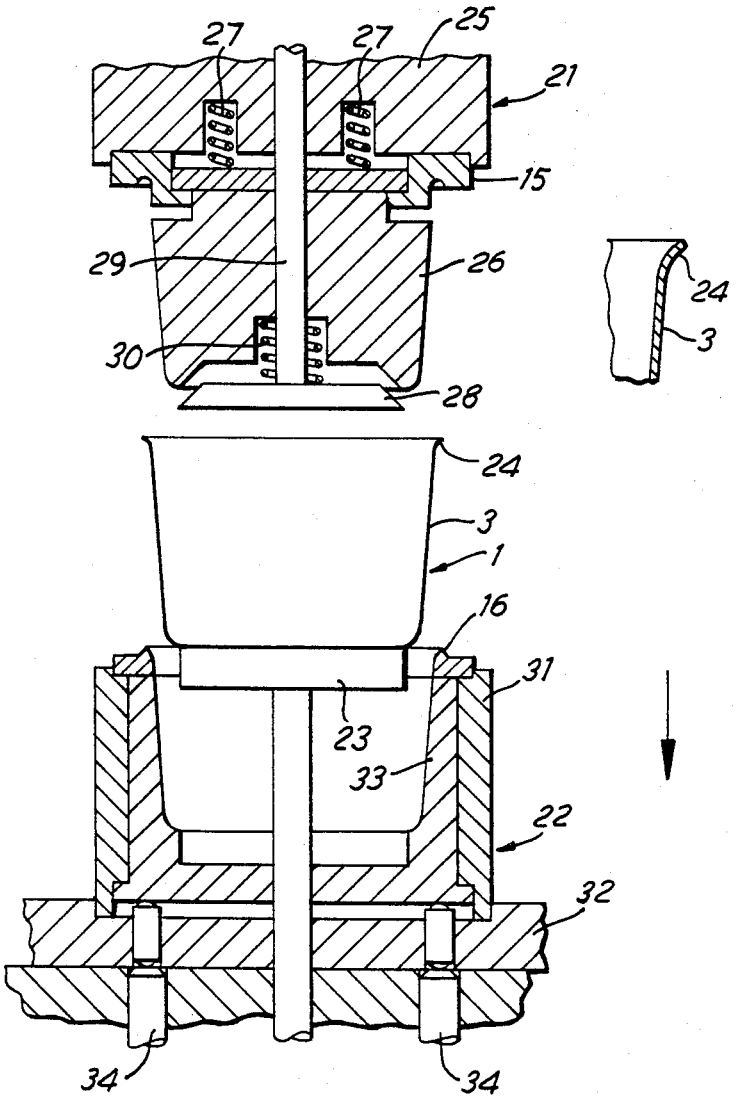
FIG. 7 is a sectioned side elevator of apparatus comprising an upper tool and a lower tool at the beginning of a second embodiment of the method.

In FIG. 7 the apparatus comprises an upper tool 21 mounted on a press (not shown) for movement towards and away from a lower tool 22. A lifter pad 23 is shown holding a drawn can body 1 as the upper tool 21 is about to progress towards the lower tool 22. The mouth of the can body 1 is defined by a start curl 24 at the top of the side wall 3 (best seen in the enlarged fragment to the right of the figure). The start curl 24 may be made by a clip trimming operation at the end of the drawing operation.

The upper tool 21 comprises a holder 25, an upper die 15 mounted in the holder 25, and a centre block 26 conforming in shape to the interior of the can body 1. The block 26 is resiliently urged, by springs 72 rooted in the holder 25, against a stop ring of the upper die. An ejector plate 28 supported on a rod 29 is resiliently urged to the open position by a spring 30 rooted in the centre block 26.

The lower tool comprises a lower die 16 is supported by a sleeve 31 supported on a base plate 32. A support cup 33, in sliding engagement with the interior of sleeve 31 is supported on pressure pins 34 which as shown in FIG. 7 urge the cup 33 against the bottom face of the lower die 16 so that the inside or die 16 and interior surface of the cup 33 can provide a support for the side wall 3 of the can body 1.

Figure 8:
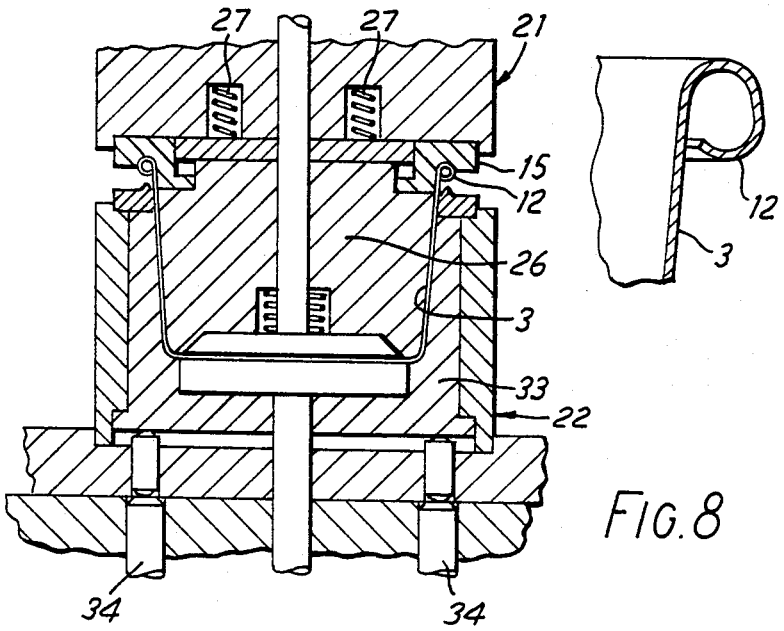
FIG. 8 is a like view of the apparatus after the upper tool has formed a preliminary curl.

In FIG. 8 the can body 1 has been clamped between the centre block 26 of the upper tool 21 and the support cup 33 of the lower tool 22.

During the clamping motion the resilience provided by springs 27 permits the can body to centre correctly in relation to the upper die 15.

With the body side wall 3 firmly clamped the upper die 15 has been brought to bear on the start curl 24 of FIG. 7 to form a preliminary curl 12 best seen in the enlarged fragment to the right of FIG. 8. During the forming of the preliminary curl the support cup 33 is held in the raised position by the pressure pins 34. As already mentioned with reference to FIG. 4 the upper die controls the desired internal and external diameters of the preliminary curl 12 because the outer portion 15*a* prevents the curled material spreading laterally from the groove.

Figure 9:
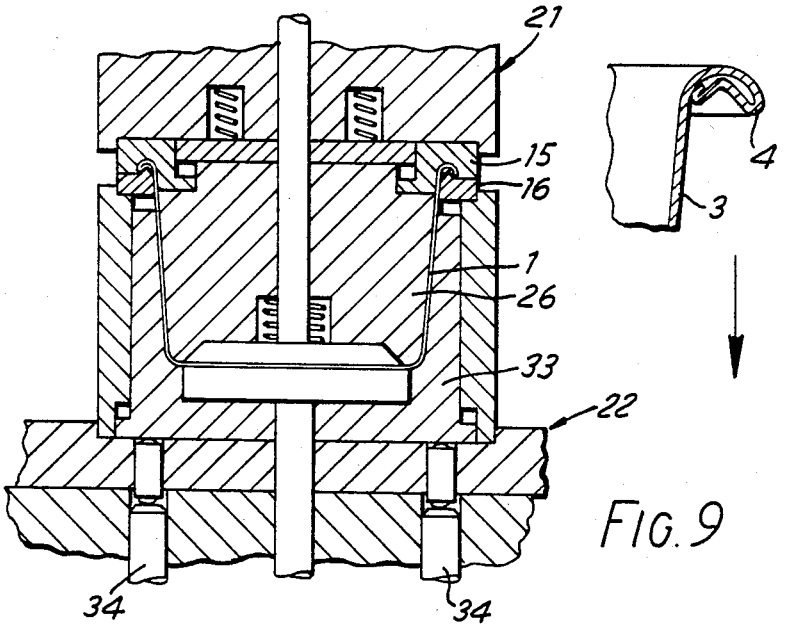
FIG. 9 is a like view of the apparatus after the upper and lower tools have co-operated to crush the preliminary curl.

In FIG. 9 the upper tool 12 has continued its downward travel so that the can body 1, supported on the centre block 26, pushes the support cup 33 downwards against the pressure pins 34 so that the clamping support of centre block and cup on the side wall 3 are maintained.

While the upper convex surface of the curl 12 (of FIGS. 7 & 8) is supported and confined by the upper die 15 the lower part of the curl is crushed against the lower die 16 to create the crushed curl 4 best seen in the enlargment to the right of FIG. 9.

After the crushed curl has been formed the upper tool 21 is raised from the lower tool 22 to the position shown in FIG. 7 so that the spring 30 is able to urge the ejector 28 to free the can body 1 from the centre block 26 to drop onto the lifter pad 23 for removal from the apparatus This apparatus has the advantage that the can body is held central to the die axis during both the formation of the preliminary curl 12 and the crushing to the finished curl so that it is possible to consistently make body curls having a relatively small radial width and a shape to receive a press formed lid.

Whilst the invention has been described in terms of a container drawn from sheet metals, such as aluminium or tinplate the method may be applied to plastics materials amenable to press forming, such as acrylonitrile-butadiene-styrene.

What is claimed is:

1. A container comprising a container body and a lid, said container body comprising a bottom wall and an upwardly, outwardly flaring tubular side wall terminating at one end in an external body curl defining the mouth of a body, said body curl having a first annulus or arcuate cross-section defined by wall portions extending radially curved upwardly, curved outwardly and curved downwardly from the side wall to define a convex external surface and a concave internal surface, a radially outermost folded portion turning radially inwardly and upwardly from an outermost periphery of said first annulus downwardly extending wall portion, a second annulus defined by wall portions extending radially upwardly, inwardly and downwardly from and relative to said radially outermost folded portion, said second annulus upwardly and downwardly extended wall portions defining an angle therebetween, said second annulus inwardly extending wall portion having an arcuate curved cross-section defined by a convex external surface and a concave internal surface, said first annulus concave internal surface having a radius of generation appreciably greater than a radius of generation of said second annulus convex external surface, said second annulus convex external surface being disposed immediately adjacent to but spaced from the concave internal surface of the first annulus, a radially innermost folded portion turning radially upwardly and outwardly from said second annulus downwardly extending wall portion and being sandwiched between the radially downwardly extending wall portion of said second annulus and the upwardly extending wall portion of the first annulus, said lid having a closure panel, and an annular channel portion surrounding to closure panel, extending axially from the channel portion to a peripheral skirt terminating in an outwardly directed curl and a gasket fixed within the channel portion, said gasket being engaged with the external surface of the convex first annulus, and said outwardly directed curl of the skirt being crimped radially inwards under the body curl so that the radially outermost folded portion engages the skirt.

* * * * *